US010293469B2

(12) United States Patent
Leong

(10) Patent No.: US 10,293,469 B2
(45) Date of Patent: May 21, 2019

(54) METHOD FOR OPERATING A POWER TOOL

(71) Applicant: Robert Bosch GmbH, Stuttgart (DE)

(72) Inventor: Chi Hoe Leong, Penang (MY)

(73) Assignee: ROBERT BOSCH GMBH, Stuttgart (DE)

( * ) Notice: Subject to any disclaimer, the term of this patent is extended or adjusted under 35 U.S.C. 154(b) by 332 days.

(21) Appl. No.: 15/315,442

(22) PCT Filed: May 4, 2015

(86) PCT No.: PCT/EP2015/059679
§ 371 (c)(1),
(2) Date: Dec. 1, 2016

(87) PCT Pub. No.: WO2015/193022
PCT Pub. Date: Dec. 23, 2015

(65) Prior Publication Data

US 2018/0200872 A1 Jul. 19, 2018

(30) Foreign Application Priority Data

Jun. 20, 2014 (DE) ..... 10 2014 211 891

(51) Int. Cl.
*B25B 21/02* (2006.01)
*B25B 23/147* (2006.01)
(Continued)

(52) U.S. Cl.
CPC ..... *B25B 23/1475* (2013.01); *B25B 21/002* (2013.01); *B25B 21/02* (2013.01);
(Continued)

(58) Field of Classification Search
CPC ..... B25B 21/00; B25B 21/02; B25B 21/026; B25B 21/008; B25B 23/14;
(Continued)

(56) References Cited

U.S. PATENT DOCUMENTS 3,975,954 A * 8/1976 Barnich ..... B23Q 11/04 73/862.23
4,316,512 A * 2/1982 Kibblewhite ..... G01D 5/24404 173/183
(Continued)

FOREIGN PATENT DOCUMENTS

CN 1505555 A 6/2004
CN 103269832 A 8/2013
(Continued)

OTHER PUBLICATIONS

International Search Report dated Jul. 30, 2015, of the corresponding International Application PCT/EP2015/059679 filed May 4, 2015.

*Primary Examiner* — Scott A Smith
(74) *Attorney, Agent, or Firm* — Norton Rose Fulbright US LLP; Gerard Messina

(57) ABSTRACT

A method for operating a power tool for screwing a screw into a workpiece. After an activation of the power tool, an electric motor is driven in order to screw the screw into the workpiece. The rotation speed of the electric motor while the screw is being screwed in is ascertained during a predefined initial time of an impact operating mode of the power tool. A rotation speed of the electric motor is ascertained after the initial time. A torque of the electric motor is at least reduced if the ascertained rotation speed of the electric motor exceeds a predefined rotation speed limit.

15 Claims, 5 Drawing Sheets

(51) Int. Cl.

| | |
|---|---|
| ***B25B 21/00*** | (2006.01) |
| *B25B 23/14* | (2006.01) |
| *B25F 5/00* | (2006.01) |
| *B25F 5/02* | (2006.01) |

(52) U.S. Cl.
CPC ..... *B25B 21/026* (2013.01); *B25B 23/147* (2013.01); *B25B 23/14* (2013.01); *B25F 5/001* (2013.01); *B25F 5/02* (2013.01)

(58) Field of Classification Search
CPC . B25B 23/1405; B25B 23/141; B25B 23/147; B25B 23/1475; B25B 23/1453; B25F 5/00; B25F 5/02; B25F 5/001
USPC ... 173/1, 2, 47, 48, 104, 109, 128, 93, 93.5, 173/93.6, 176, 178, 179, 180, 181, 183, 173/217; 81/429, 469; 73/862.23, 73/862.22
See application file for complete search history.

(56) References Cited

U.S. PATENT DOCUMENTS

| | | | | |
|---|---|---|---|---|
| 5,131,130 | A * | 7/1992 | Eshghy | B25B 23/14 29/407.02 |
| 5,181,575 | A * | 1/1993 | Maruyama | B25B 23/1453 173/180 |
| 5,216,795 | A * | 6/1993 | Hansson | B25B 23/14 29/407.02 |
| 5,457,866 | A * | 10/1995 | Noda | B25B 21/026 29/407.02 |
| 5,492,185 | A * | 2/1996 | Schoeps | B25B 23/1453 173/177 |
| 6,167,606 | B1 * | 1/2001 | Mueller | B23P 19/066 173/181 |
| 6,598,684 | B2 * | 7/2003 | Watanabe | B25B 21/02 173/176 |
| 6,968,908 | B2 * | 11/2005 | Tokunaga | B25B 21/02 173/181 |
| 7,556,103 | B2 * | 7/2009 | Matsunaga | B25B 23/147 173/176 |
| 7,681,659 | B2 * | 3/2010 | Zhang | B23D 59/001 173/1 |
| 8,678,106 | B2 * | 3/2014 | Matsunaga | B25B 21/008 173/176 |
| 8,919,456 | B2 * | 12/2014 | Ng | G05B 15/02 173/11 |
| 9,469,019 | B2 * | 10/2016 | Profunser | B25B 21/02 |
| 9,597,784 | B2 * | 3/2017 | McClung | B25B 21/026 |
| 2002/0020538 | A1 * | 2/2002 | Giardino | B25B 23/1405 173/176 |
| 2002/0033267 | A1 * | 3/2002 | Schweizer | B25B 23/14 173/2 |
| 2005/0263303 | A1 * | 12/2005 | Shimizu | B25B 23/1475 173/2 |
| 2005/0263304 | A1 * | 12/2005 | Sainomoto | B25B 21/026 173/2 |
| 2007/0210733 | A1 * | 9/2007 | Du | H02K 1/278 318/268 |
| 2011/0308827 | A1 * | 12/2011 | Kaufmann | B25B 23/14 173/1 |
| 2012/0222876 | A1 * | 9/2012 | Schmidt | B25B 21/02 173/1 |
| 2013/0008679 | A1 * | 1/2013 | Nishikawa | B25B 21/02 173/93 |
| 2013/0025892 | A1 * | 1/2013 | Mashiko | B25B 21/02 173/2 |

FOREIGN PATENT DOCUMENTS

| | | | |
|---|---|---|---|
| EP | 1695794 | A2 | 8/2006 |
| EP | 2576146 | B1 | 5/2014 |
| JP | H02198772 | A | 8/1990 |
| JP | 2012187695 | A | 10/2012 |
| JP | 2013146846 | A | 8/2013 |
| JP | 2015020243 | A | 2/2015 |

* cited by examiner

METHOD FOR OPERATING A POWER TOOL

FIELD

The present invention relates to a method, a control device for a power tool, and to a power tool.

BACKGROUND INFORMATION

Conventionally, the torque of a power tool, in particular of an impact driver, may be controlled to a predefined maximum torque value. Conventionally, the electric motor of the power tool may be shut off upon occurrence of a malfunction.

SUMMARY

An object of the present invention is to furnish an improved method and an improved control device for operating a power tool.

An advantage of the method described is that a screw can be screwed into a workpiece more easily, damage to the screw or to the workpiece in particular being avoided. This advantage is achieved by the fact that the torque of the electric motor is at least reduced if, after an initial time, the rotation speed of the electric motor exceeds an ascertained rotation speed limit. Experiments have shown that in the context of screwing a screw into a workpiece, once a seated position is reached the rotation speed of the electric motor rises again prior to any damage to the screw or to the workpiece. In accordance with the present invention, damage to the workpiece and/or to the screw may be prevented by the fact that after the initial time in the impact operating mode, upon recognition of a rise in the rotation speed of the electric motor above a rotation speed limit, the torque at least is reduced or the electric motor is shut off. The rotation speed limit can be determined, for example, by experiments and stored.

In an embodiment, for precise adaptation of the method to the respective screw situation, the rotation speed limit is ascertained while the screw is being screwed into the workpiece, as a function of the rotation speed of the electric motor upon screwing of the screw into the workpiece. An individual rotation speed limit can thereby be ascertained for each screw situation. It is thereby possible to ensure that the screwing-in operation is terminated not too soon and not too late.

By ascertaining the rotation speed limit while screwing in, it is possible to ascertain the rotation speed limit individually as a function of the screw, in particular depending on the diameter of the screw, on the threading of the screw, on the nature of the workpiece, in particular on the hardness of the workpiece. The rotation speed is ascertained during an initial time of the impact operating mode in the context of screwing the screw into the workpiece, and the rotation speed limit is ascertained as a function of the ascertained rotation speed. The rotation speed limit can thus be detected precisely as a function of the conditions that are present. When a power tool having an impact operating mode is used, the impact operating mode is used to tighten the screw. The impact operating mode thus represents the operating state in which the risk of damaging the screw and/or the workpiece is high. It is therefore advantageous to ascertain the rotation speed limit as a function of the rotation speed during the initial time of the impact operating mode of the power tool.

In an embodiment, the rotation speed limit is ascertained as a function of an ascertained maximum rotation speed during the initial time. For example, the rotation speed limit can be calculated as a function of the maximum rotation speed multiplied by a factor and/or added to a constant. Depending on the embodiment selected, instead of the maximum rotation speed an average value of the rotation speed, or multiple values of the ascertained rotation speed, can also be used in order to calculate the rotation speed limit.

In a further embodiment an impact operating mode of the power tool is recognized as a function of parameters of the power tool. For example, an impact operating mode of the power tool is recognized if, during a starting time, the rotation speed is less than a third comparison value and/or the current of the electric motor is greater than a fourth comparison value. Both the current and the rotation speed can be used as parameters for precise recognition of an impact operating mode.

In a further embodiment the impact operating mode can additionally be precisely recognized by the fact that a measured time interval between two impacts of the impact operating mode is additionally detected, and if the time interval between two impacts of the impact operating mode is less than a first comparison value. Further precision in terms of recognizing the impact operating mode is achieved by the fact that an impact operating mode is recognized if a standard deviation of the ascertained rotation speed of the electric motor during the initial time of the impact operating mode is less than a second comparison value. The beginning of the impact operating mode can thereby be precisely specified.

In a further embodiment, a workpiece that has a predefined minimum thickness is recognized if, during the starting time of the power tool, the rotation speed of the electric motor is less than the third comparison value and the current through the electric motor is greater than the fourth comparison value. Improved execution of the method is thereby achieved.

In a further embodiment the torque of the electric motor is at least reduced after the initial time if a predefined first time span has elapsed. A maximum upper limit for the duration of the screwing-in operation is thereby predefined. The result is that a safety limit for the duration of the screwing-in operation is specified.

In a further embodiment, a second method for limiting the torque in the context of screwing in a screw with the aid of the power tool is carried out if, during the starting time after activation of the power tool, the current through the electric motor is less than a fifth comparison value, in the second method an impact operating mode of the power tool being terminated after a predefined second time span. This method is applied in particular for thin workpieces, the second time span being, for example, shorter than the first time span.

In a further embodiment the second method is carried out if additionally, during the starting time after activation of the power tool, a change in the ascertained rotation speed lies outside a predefined range and/or a change in the ascertained current lies outside a second range. A distinction between the methods can thereby be precisely achieved. In particular, the presence of a workpiece for which the method according to claim 1 is less suitable can thereby be recognized.

In a further embodiment, during the second method the torque of the electric motor is at least reduced or the electric motor is completely shut off if, after the initial time, a change in the ascertained rotation speed of the electric motor lies outside a predefined rotation speed range and/or a change in the ascertained current lies outside a predefined current range.

Atypical rotation speed changes and/or current changes are thereby recognized and are used as a signal to reduce the torque of the electric motor. Damage to the screw and/or to the workpiece, in particular in the context of a thin workpiece, can thereby be avoided.

The present invention is explained in further detail below with reference to the Figures.

DETAILED DESCRIPTION OF EXAMPLE EMBODIMENTS

Figure 1:
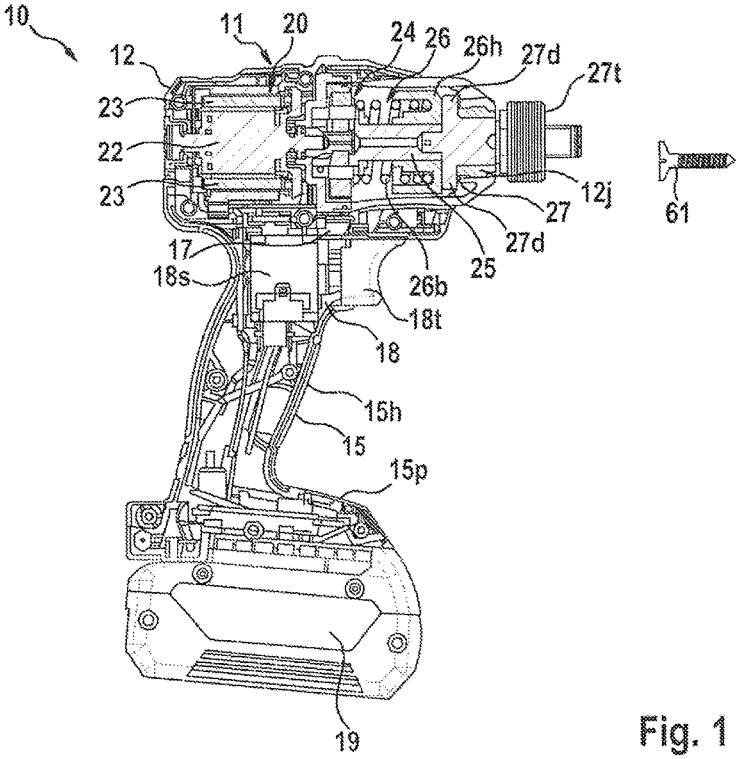
FIG. 1 is a schematic cross section through a power tool.

FIG. 1 schematically depicts a power tool 10 that is embodied in the form of an impact driver 10. Impact driver 10 has a housing 11 that has a cylindrical main body 12 and a handle 15 attached thereto. A battery 19 is disposed oppositely to main body 12. Disposed in main body 12 is an electric motor 20 in the form of a brushless DC motor 20 having a planetary gearbox 24, a spindle 25, an impact generating mechanism 26, and an anvil 27. Electric motor 20 serves as a drive source for the rotating impact generating mechanism 26. The rotation speed of electric motor 20 is reduced with the aid of planetary gearbox 24 and then transferred to spindle 25. The rotational force of spindle 25 is converted into a rotating impact force by impact generating mechanism 26, a hammer **26*h* and a compression spring 26*b* being provided for that purpose. An impact force of hammer 26*h* is transferred to anvil 27. Anvil 27 is mounted rotatably around an axis and is driven by the rotational impact force of hammer 26*h*. Anvil 27 is held by a bearing 12*j* rotatably in housing 11, which is disposed on a front side of main body 12. Anvil 27 can thus rotate around the rotation axis but cannot move along the rotation axis. Provided on a front side of anvil 27 is a receptacle 27*t* for receiving a screw 61 via an insert. Screw 61** represents the tool that is driven by the power tool.

Handle 15 of housing 11 is grasped by an operator in order to use power tool 10. The handle has a holding portion **15*h* and a lower end portion 15*p* that adjoins the lower end of handle portion 15*h*. Battery 19, which supplies power tool 10 with power, is provided on lower end portion 15*p*. Provided on handle portion 15*h* is a main switch 18 which has a trigger 18*t* that can be actuated with a finger. Main switch 18 furthermore has a switch unit 18*s* that is used to switch the power tool on or off. Trigger 18*t* is used to increase a variable for control application to electric motor 20 as a function of the actuation travel of trigger 18*t*. The actuation travel of trigger 18*t* is detected, for example, with the aid of switch unit 18*s*, for example as a resistance value, and is reported to a control circuit (46, FIG. 3). If the resistance value of switch unit 18*s* of main switch 18 changes in accordance with the retraction state of trigger switch 18*t*, the control circuit (46, FIG. 3) then, for example, adapts a rotation speed of the control application to electric motor 20. The rotation speed and/or the torque of electric motor 20** can thereby be controlled.

Also provided, above main switch 18, is a direction switch 17 that specifies the rotation direction of receptacle **27*t*. Power tool 10** can be operated in a right-rotating clockwise direction, i.e. in normal operating mode, for example to screw in a screw, or in a left-rotating direction, i.e., counter-clockwise, in an unscrewing operating mode, for example in order to unscrew a screw.

Figure 2:
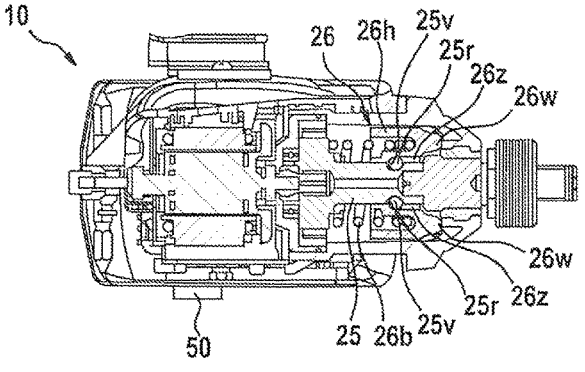
FIG. 2 is a second cross section through the power tool.

FIG. 2 is a further cross section showing further details of power tool 10. Hammer **26*h* of impact generating mechanism 26 is connected to spindle 25 via V-shaped first guidance grooves 25*v*, V-shaped second guidance grooves 26*z*, and steel balls 25*r*. First guidance grooves 25*v* are disposed on a front side of spindle 25 on the outer surface, first guidance grooves 25*v* having semicircular portions that are directed with the V-shaped openings outward. In addition, the V-shaped second guidance grooves 26*z* are disposed in an inner surrounding surface of hammer 26*h* oppositely to first guidance grooves 25*v* of spindle 25. Second guidance grooves 26*z* have a semicircular cross section, the grooves being open in a forward direction. Steel balls 25*r* are disposed between first guidance grooves 25*v* and second guidance grooves 26*z*. The result is that hammer 26*h* is mounted rotatably through a predefined angle with respect to a reference position of spindle 25, and is capable of moving in an axial direction with respect to a longitudinal axis of spindle 25. Compression spring 26*b* is furthermore in contact with the outer surface of spindle 25 and with hammer 26*h*, so that hammer 26*h* is preloaded toward spindle 25**.

Impact projections **26*w* are configured at a front end surface of hammer 26*h* in order to generate impacts onto anvil 27 at two points offset 180° from one another. Anvil 27 is furthermore configured, at the two points offset 180° in a circumferential direction, with impact arms 27*d* (FIG. 2) that receive the impacts of impact projections 26*w* of hammer 26*h*. Hammer 26*h* is held on spindle 25 by the preload force of compression spring 26*b*, so that impact projections 26*w* of hammer 26*h* abut against impact arms 27*d* of anvil 27. In this state, hammer 26*h* then rotates together with spindle 25 when spindle 25 is rotated by electric motor 20, and the rotational force of hammer 26*h* is transferred to anvil 27 via impact projections 26*w* and impact arms 27*d***. In this fashion, for example, a screw can be inserted into a workpiece in an impact operating mode.

Upon insertion, the screw can reach a position in the workpiece at which a screwing-in resistance exceeds the torque of hammer **26*h*. The screwing-in resistance is transferred to anvil 27 as a torque. The result is that hammer 26*h* is offset back from the spindle against the preload force of compression spring 26*b*, and impact projections 26*w* of the hammer ride over impact arms 27*d* of anvil 27. Impact projections 26*w* are thereby released from abutment against impact arms 27*d*, so that impact projections 26*w* can rotate freely through a specified angle. When impact projections 26*w* of hammer 26*h* move over impact arms 27*d* of anvil 27, the hammer then accelerates its rotary motion. As a result of the preload force of compression spring 26*b*, hammer 26*h* is pushed back toward anvil 27 within the specified angle so that impact projections 26*w* of the hammer once again come into contact with impact arms 27*d* of anvil 27. As a result of the impact of impact projections 26*w* onto impact arms 27*d*, an elevated torque is exerted on anvil 27 and thus on receptacle 27***t* and on screw 61. This process represents an impact operating mode and is continuously repeated during the impact operating mode.

Figure 3:
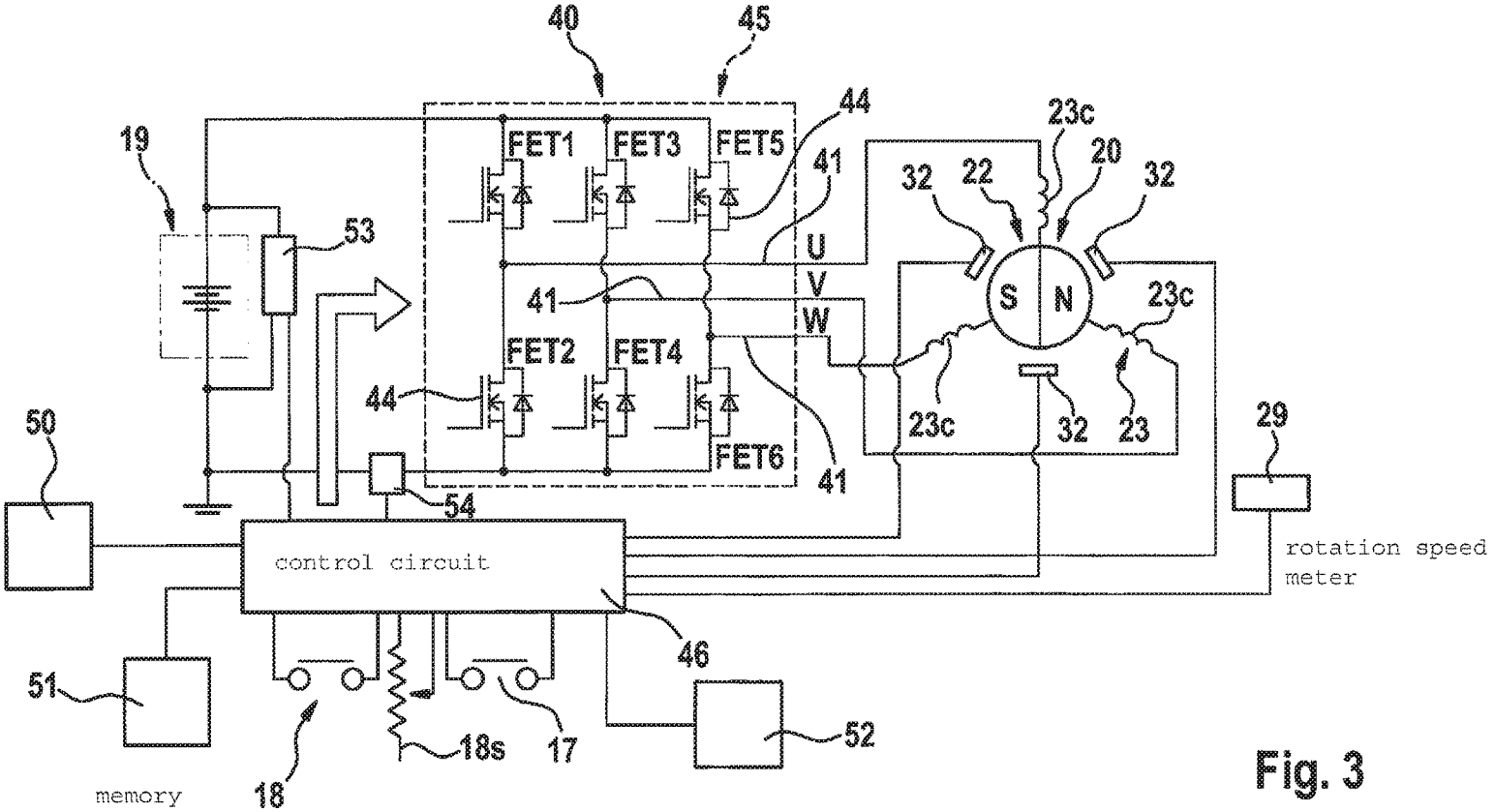
FIG. 3 schematically depicts a control circuit for the power tool.

FIG. 3 schematically depicts a circuit assemblage of power tool 10 of FIG. 1 for applying control to electric motor 20, which is configured, e.g., as a brushless DC motor and is driven by a control application circuit 40. Electric motor 20 has a rotor 22 having permanent magnets, and a stator 23 having drive coils 23C. Control application circuit 40 is an electrical circuit for applying control to electric motor 20, and has a three-phase bridge circuit 45 that has six switching elements 44, for example in the form of field effect transistors. Also provided is a control circuit 46 that applies control to switching elements 44 of three-phase bridge circuit 45 as a function of switch unit 18*s*.

Three-phase bridge circuit 45 has three output leads 41 that are connected to the corresponding control coils 23*c* of electric motor 20. Control circuit 46 is configured to apply control to switch elements 44, based on signals of magnetic sensors 32, in such a way that an electric current flows sequentially through drive coils 23*c* in order to rotate rotor 22 at a desired rotation speed and/or with a desired torque. Control circuit 46 can furthermore measure a rotation speed of electric motor 20 with the aid of magnetic sensors 32. Control circuit 46 is furthermore connected to a measuring device 53 that detects the charge state of battery 19, in particular the voltage of battery 19, and conveys it to control circuit 46.

Electronic control circuit 46 is furthermore connected to a memory 51. Limit values, data, characteristic curves, characteristics diagrams, and/or calculation methods and/or formulas are stored in memory 51. Control circuit 46 detects, with the aid of measuring device 53, the present voltage of battery 19. Control circuit 46 can furthermore measure the current of electric motor 20 with a current meter 54, and/or the rotation speed of electric motor 20 with a rotation speed meter 29. The current and/or the rotation speed can be used by control circuit 46 to determine when an impact operating mode of the power tool begins. Corresponding thresholds or limit values for the current of the electric motor and the rotation speed of the electric motor, which values electric motor 20 exceeds when an impact operating mode starts, are stored for that purpose in memory 51.

Control circuit 46 is configured to execute a method for operating the power tool for screwing a screw into a workpiece; after an activation of the power tool the electric motor being driven in order to screw the screw into the workpiece; control circuit 46 ascertaining the rotation speed of the electric motor while the screw is being screwed in, during an initial time of an impact operating mode of the power tool; control circuit 46 ascertaining a rotation speed limit as a function of the ascertained rotation speed; a rotation speed of the electric motor being ascertained after the initial time; a torque of the electric motor being at least reduced by control circuit 46 if the ascertained rotation speed of the electric motor exceeds a predefined rotation speed limit.

A characteristics diagram, a characteristic curve, a table, or a corresponding calculation method can be used to determine the rotation speed limit. The characteristics diagram, characteristic curve, table, or calculation method determine a correlation between the rotation speed measured during the initial time and the rotation speed limit. If the electric motor reaches the rotation speed limit after the initial time, electric motor 20 is then stopped by control circuit 46, or an electronic clutch is activated for a short period of time and then the electric motor is completely stopped.

Figures 4A, 4B, 4C:
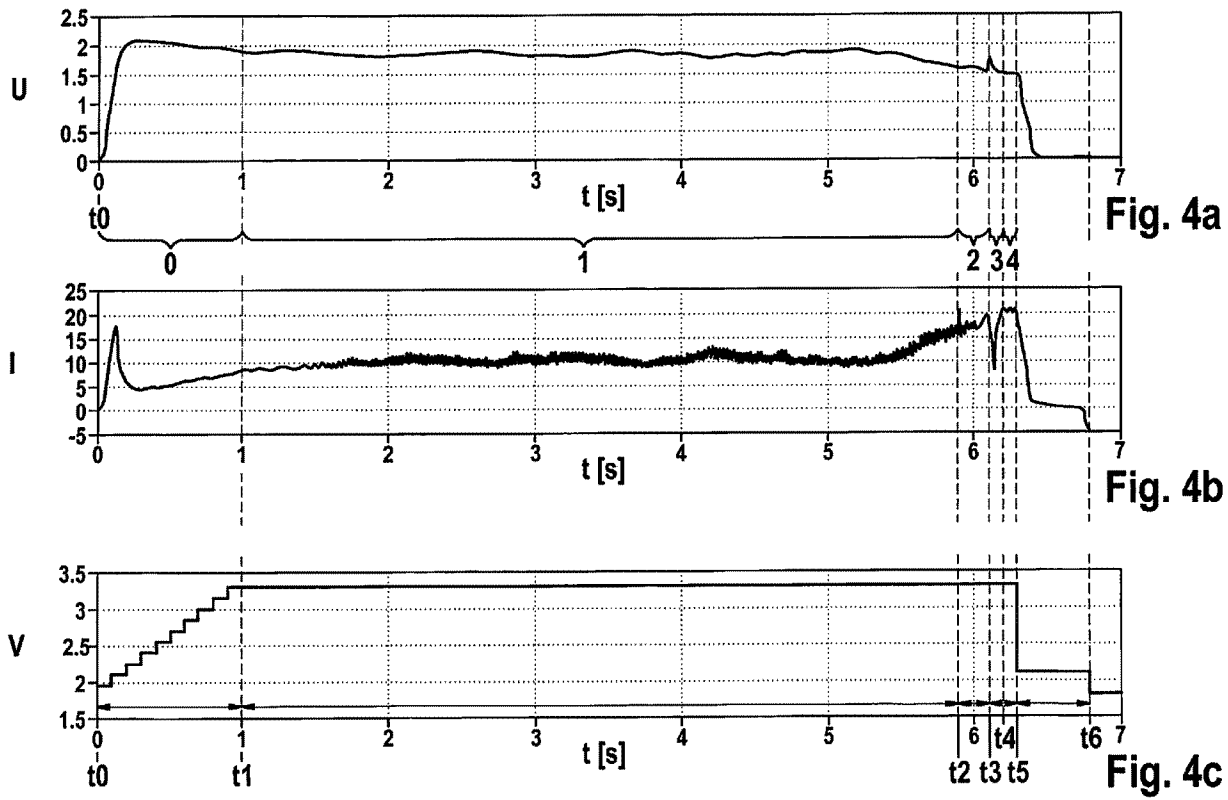
FIG. 4 is a diagram showing a time profile of the speed, current, and voltage of an electric motor for a screwing-in operation.

FIG. 4 shows in a top diagram (FIG. 4*a*) the time profile of the rotation speed U of the electric motor during a screwing-in operation, in a center diagram (FIG. 4*b*) the time profile of the current I during the screwing-in operation, and in a bottom diagram (FIG. 4*c*) the time profile of the voltage V that is applied by the control circuit to the electric motor.

At a zero time t0 in a zero-th phase, the voltage V at the electric motor is increased over time to a maximum voltage at a first time t1. In the exemplifying embodiment depicted, the voltage V is increased to the maximum voltage in steps. Depending on the embodiment selected, other time profiles for increasing the voltage V during the zero-th phase can also be selected. In the initial phase the rotation speed U of the electric motor rises quickly and then, after a maximum rotation speed is reached, slowly decreases again somewhat until the end of the zero-th phase. The current I flowing through the electric motor, which is depicted in the second diagram (FIG. 4*b*), quickly rises to a maximum value after the application of voltage to the electric motor, and then decreases again to a lower value, rising again somewhat until the end of the zero-th phase. The switch for operating the power tool is already completely pressed at the beginning of the zero-th phase. The switch remains completely pressed during further operation as well. The zero-th phase lasts from the zero time t0 to the first time t1.

Figure 5:
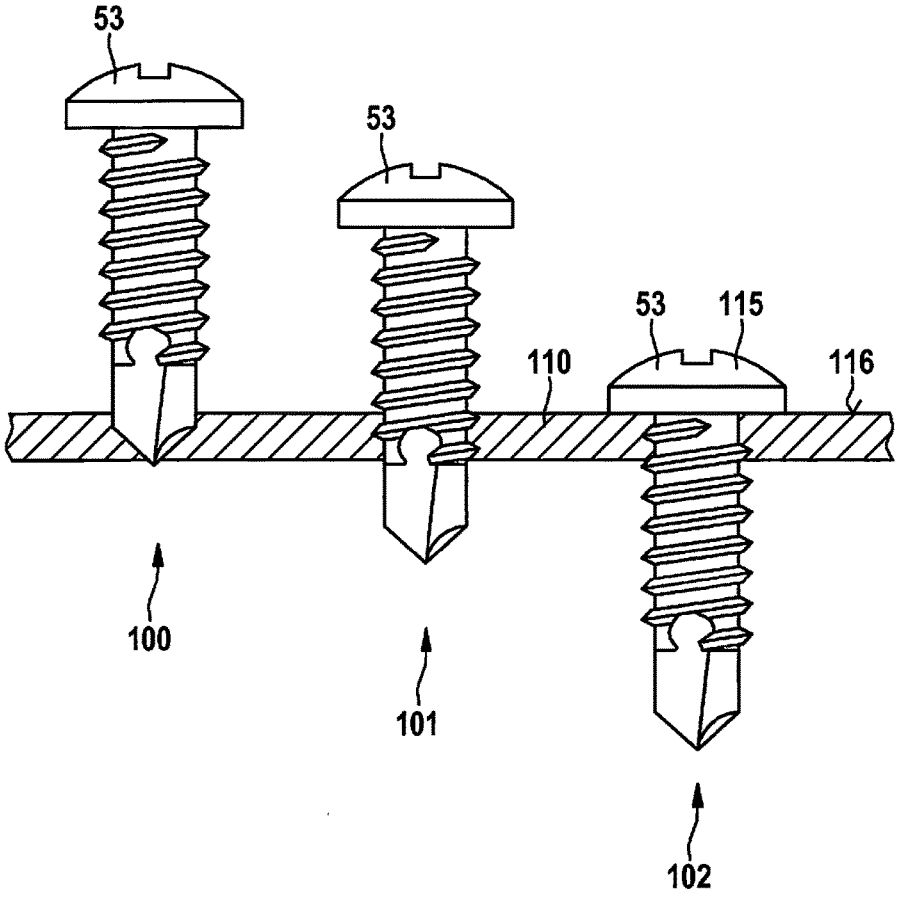
FIG. 5 shows a screw in three different screwed-in positions in a workpiece.

The zero-th phase is followed by a first phase. The first phase lasts from the first time t1 to the second time t2. Both during the zero-th phase and during the first phase, screw 53, as depicted in first position 100 of FIG. 5, is drilled with its tip into workpiece 110. Workpiece 110 is configured, for example, in the form of a metal plate. The current I rises slowly during the first phase, the applied voltage V remaining constant at the maximum value. The rotation speed U of the electric motor fluctuates slightly during the first phase and then decreases somewhat until the end of the first phase. In contrast thereto, the current I through the electric motor rises somewhat at the end of the first phase 1. During the zero-th and the first phase, the drilling operation in workpiece 110 is executed with no need for an impact operating mode of the power tool. Once screw 53 has drilled through workpiece 110, the second phase 2, in which screw 53 cuts a thread into workpiece 110, begins. This process requires greater torque, so that the impact mechanism of the power tool is activated and the current through the power tool rises. The speed also decreases. Depending on the thickness of workpiece 110, the time span for the second phase 2 can be very short and can encompass, for example, only two or three thread turns. The second phase 2 lasts from the second time t2 to a third time t3. Once the thread has been cut into workpiece 110 by screw 53, a third phase, in which the screw 53 is screwed into the thread cut into workpiece 110, begins at the third time t3. Here the speed rises appreciably and the current drops appreciably. The screw resistance during the third phase 3 is low, so that the rotation speed rises sharply and the current decreases sharply. This process state is depicted in a second position 101 of FIG. 5.

Once a head 115 of screw 53 reaches an upper side 116 of workpiece 110, as depicted in second position 102 in FIG. 5, a fourth phase 4 then begins at a fourth time t4. When head 115 of screw 53 reaches upper side 116 of workpiece 110, the screwing-in resistance then increases quickly and appreciably. The impact operating mode of the power tool is activated again, and screw 53 is tightened with a high torque.

During the fourth phase 4 the rotation speed of the electric motor rises again, similarly to the second phase 2, and the current again drops.

An advantage of the method described is that during the fourth phase 4, control circuit 46 of the power tool recognizes that the rotation speed of the electric motor is exceeding the ascertained rotation speed limit, so that control circuit 46 reduces the voltage for the electric motor and/or opens a clutch between the electric motor and the receptacle of the screw. This situation occurs at the end of the fourth phase 4, at a fifth time t5. Depending on the embodiment selected, the maximum voltage can be in the region of 3.3 V and can decrease after the fourth zone 4 to a voltage of, for example, 2.2 V. After a predefined rundown time of, for example, 0.5 s to a sixth time t6, the voltage can furthermore be completely shut off or at least can fall below a value at which the electric motor turns. This value can be, for example, in the region of 1.8 V.

Figure 6:
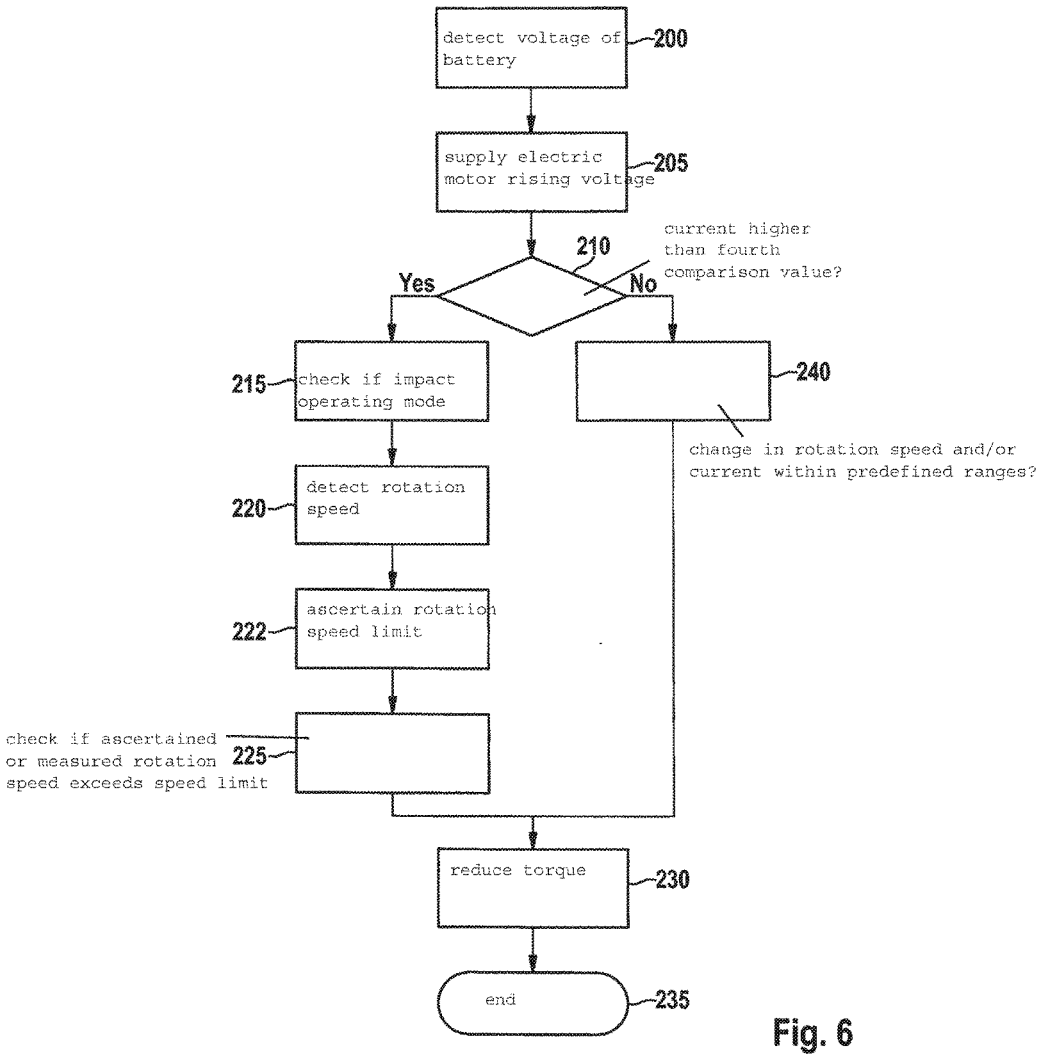
FIG. 6 shows a schematic program sequence for controlling the torque of the power tool.

FIG. 6 schematically depicts a program sequence for operating the electric motor. At program point 200, which is optional, a voltage of battery 19 with which the electric motor of the power tool is being driven is detected by control circuit 46. At program point 205 the electric motor is then supplied with a rising voltage in accordance with the zero-th phase of FIG. 4. In addition, depending on the embodiment selected, at program point 205 the voltage can also be increased to the maximum voltage in one step.

At a subsequent program point 210 a query is made as to whether the current through the electric motor is higher than a fourth comparison value. The comparison value can be, for example, between 10 A and 20 A. A query as to whether the rotation speed of the electric motor is lower than a third comparison value is also made at program point 210. The third comparison value can be, for example, between 8000 and 20,000 revolutions per minute. The third and the fourth comparison value are stored in memory 51. If both queries are satisfied, execution then branches to program point 215.

At program point 215 a check is made as to whether an impact operating mode is present. For that purpose, a check is made as to whether the time span between two impacts is less than a first limit value. The first limit value can be in the range between 0.01 second and 0.05 second. The first limit value is stored in memory 51. The impacts can be detected, for example, acoustically on the basis of acoustic sensors or can be ascertained based on the time profile of the current through the electric motor. A check is also made as to whether a standard deviation of the measured rotation speed is less than a second limit value. The second limit value can be in the range between 30 and 90. The second limit value is stored in memory 51. If both queries of program point 51 are satisfied, an impact operating mode of the power tool is unequivocally recognized, and execution branches to program point 220. The limit values are ascertained experimentally and can vary from one power tool to another, for example depending on the type of electric motor.

The standard deviation can be calculated, for example, using the following formulas:

The standard deviation $\sigma_x$ of a random variable X is defined as the square root of the variance Var(X):

$$\sigma_x := \sqrt{\mathrm{Var}(X)}.$$

The variance $$\mathrm{Var}(X) = E((X - E(X))^2) = E(X^2) - (E(X))^2$$

of X is always greater than or equal to 0. The symbol $E_{(\cdot)}$ identifies the expected value.

With a second type of calculation the first time span is subdivided into a predefined number of sub-intervals, for example into ten sub-intervals. Then a standard deviation is calculated, for each sub-interval, for the measured values for the rotation speed. An averaged standard deviation for the rotation speed is then ascertained, by averaging, from the ten standard deviations for the current.

At the subsequent program point 220 the rotation speed of the electric motor is detected. For example, a time profile of the rotation speed, and/or individual values of the rotation speed at time intervals, or a maximum value of the rotation speed, are detected. A rotation speed limit is then ascertained at program point 222 as a function of the detected rotation speed. The rotation speed limit can be ascertained, for example, as a function of the detected maximum rotation speed, of the detected rotation speed values, and/or as a function of the time profile of the rotation speed during measurement at program point 220. The characteristic curves, characteristics diagrams, and/or calculation methods and/or formulas of memory 51 are used for calculation. In a simple case, the rotation speed limit is calculated by multiplying the measured maximum rotation speed by a constant greater than 1. A constant rotation speed value can furthermore be taken into consideration in addition to the detected rotation speed. The constant rotation speed value is stored in memory 51. The rotation speed limit can be calculated, for example, from the ascertained maximum rotation speed by adding the constant rotation speed value. The rotation speed value can be, for example, in the range between 200 and 1000 revolutions per minute. A characteristics diagram, a characteristic curve, a table, or a corresponding calculation method, which are stored in the memory, can furthermore be employed in order to calculate the rotation speed limit.

In an embodiment, the rotation speed limit is ascertained as a function of the charge state of the battery, which was optionally ascertained at program point 200. The charge state of the battery can be taken into consideration, for example, in the form of a second factor. The ascertained rotation speed limit is thus multiplied by the second factor. Depending on the embodiment selected, the rotation speed can be ascertained at program point 200 only after a predefined delay time of, for example, 0.1 to 0.2 s.

In a further embodiment a predefined rotation speed limit that is independent of the rotation speed during the impact operating mode, and that in a simple embodiment is used as an ascertained rotation speed limit, can be stored in the memory.

At a subsequent program point 225 a check is made as to whether the presently ascertained or measured rotation speed of the electric motor exceeds the ascertained rotation speed limit, or whether a predefined second time span since recognition of the impact operating mode has elapsed. The second time span can be, for example, in the range between 0.1 and 0.3 s.

If one of the two queries is satisfied, execution then branches to program point 230. At program point 230 a torque of the electric motor is reduced by control circuit 46, for example the voltage of the electric motor being reduced and/or a clutch between the electric motor and drive system being opened. After a predefined time span, execution can then branch from program point 230 to an end point 235 at which the electric motor is shut off or at least the voltage is reduced sufficiently that the electric motor is no longer turning.

If the result of the query at program point 210 is that within a predefined time interval with respect to program point 205 neither the current or the rotation speed respectively exceeds or falls below the predefined limit values, execution then branches to program point 240.

Depending on the embodiment selected, in addition to the check as to whether neither the current nor the rotation speed respectively exceeds or falls below the predefined limit values, it is also possible to check whether a predefined change in rotation speed and/or a predefined change in current are present. The values for the predefined change in rotation speed and/or the predefined change in current are stored in memory 51. In this embodiment execution branches to program point 240 only when neither the current nor the rotation speed respectively exceeds or falls below the predefined limit values, and the predefined change in rotation speed and/or the predefined change in current are present.

In a first embodiment, at program point 240 a check is made as to whether a change in the rotation speed and/or a change in the current are within predefined ranges. If this is not so, execution then branches to program point 230. The predefined ranges are stored in the memory. In addition, after a predefined maximum screwing-in time execution branches from program point 240 to program point 230. The maximum screwing-in time can be in the range from 0.1 to 0.3 second.

In a further embodiment, at program point 240 a check is made as to whether an impact operating mode is present. For this, a check is made as to whether the time span between two impacts is less than a first limit value. The first limit value can be in the range between 0.01 second and 0.05 second. The first limit value is stored in memory 51. The impacts can be detected, for example, acoustically on the basis of acoustic sensors or can be ascertained based on the time profile of the current through the electric motor. A check is also made as to whether a standard deviation of the measured rotation speed is less than a second limit value. The second limit value can be in the range between 30 and 90. The second limit value is stored in memory 51. If both queries of program point 240 are satisfied, an impact operating mode of the power tool is unequivocally recognized. The limit values are ascertained experimentally and can vary from one power tool to another, for example depending on the type of electric motor. Once the impact operating mode is recognized, after a defined time span of, for example, 0.05 to 0.2 second execution branches to program point 230. At program point 230 the torque of the electric motor is reduced by control circuit 46, for example the voltage of the electric motor being reduced and/or a clutch between the electric motor and drive system being opened. After a predefined time span, execution can then branch to end point 235, at which the electric motor is shut off or at least the voltage is reduced sufficiently that the electric motor no longer turns. In addition, depending on the embodiment selected, the power tool can be configured to indicate whether the method according to program step 215 or the method according to program step 240 is being carried out. The method according to program step 215 indicates a thick workpiece having a predefined minimum thickness. The method according to 240 indicates a workpiece that is thinner than the predefined minimum thickness. The indication can be made optically, acoustically, or haptically.

Program steps 215 and 220 are carried out during phase 2 of FIG. 4. Program step 225 is carried out during phase 4 of FIG. 4. Program step 240 can be carried out during phases 2 to 4 of FIG. 4.

Depending on the embodiment selected, in a simple embodiment also only the current can be compared with the limit value, or only the rotation speed can be compared with the limit value, at program point 210 in order for execution to branch from program point 210 to program point 215.

In addition, in a simple embodiment also only the time between two impacts of the impact operating mode, or the standard deviation of the rotation speed of the electric motor, can be used at program point 215 to recognize an impact operating mode.

In addition, depending on the embodiment selected, program point 215 can be omitted so that execution switches from program point 210 directly to program point 220.

What is claimed is:

1. A method for operating a power tool for screwing a screw into a workpiece, comprising:

after an activation of the power tool, driving an electric motor to screw the screw into the workpiece;

ascertaining a rotation speed of the electric motor, while the screw is being screwed in, during a predefined initial time of an impact operating mode of the power tool;

ascertaining a rotation speed of the electric motor after the initial time; and at least reducing a torque of the electric motor if the ascertained rotation speed of the electric motor exceeds a predefined rotation speed limit.

2. The method as recited in claim 1, further comprising:

ascertaining the rotation speed limit as a function of the rotation speed ascertained during the initial time of the impact operating mode;

ascertaining a rotation speed of the electric motor after the initial time; and at least reducing a torque of the electric motor if the ascertained rotation speed of the electric motor exceeds the ascertained rotation speed limit.

3. The method as recited in claim 2, wherein a maximum rotation speed of the electric motor is ascertained during the initial time as a rotation speed; and wherein the rotation speed limit is ascertained as a function of the ascertained maximum rotation speed.

4. The method as recited in claim 2, wherein a predefined rotation speed value is additionally being taken into consideration in the context of ascertaining the rotation speed limit.

5. The method as recited in claim 4, wherein the initial time during the impact operating mode is recognized if, during a starting time after activation of the power tool, the rotation speed is less than a third comparison value and a current through the electric motor is greater than a fourth comparison value.

6. The method as recited in claim 5, wherein the initial time during the impact operating mode being recognized if additionally a measured time interval between two impacts of the impact operating mode is less than a first comparison value.

7. The method as recited in claim 5, wherein the initial time during the impact operating mode is recognized if additionally a standard deviation of the ascertained rotation speed of the electric motor during the initial time is less than a second comparison value.

8. The method as recited in claim 5, wherein a workpiece having a predefined minimum thickness is recognized if, during the starting time after activation of the power tool, the rotation speed is less than the third comparison value and the current through the electric motor is greater than the fourth comparison value; and a presence of a workpiece having the minimum thickness being indicated by the power tool.

9. The method as recited in claim 1, wherein the torque of the electric motor is at least reduced after the initial time if a predefined first time span has elapsed.

10. The method as recited in claim 1, wherein a second method is carried out if, during the starting time after activation of the power tool, the current through the electric motor is less than a fifth comparison value, wherein in the second method, an impact operating mode of the power tool being terminated after a predefined second time span.

11. The method as recited in claim 10, wherein the second method is carried out if, during the starting time after activation of the power tool, at least one of: i) a change in the ascertained rotation speed lies outside a predefined range, and ii) or a change in the ascertained current lies outside a second range.

12. The method as recited in claim 10, after the initial time a torque of the electric motor being at least reduced if at least one of: i) a change in the ascertained rotation speed of the electric motor lies outside a predefined rotation speed range, and ii) a change in the ascertained current lies outside a predefined current range.

13. The method as recited in claim 1, wherein the electric motor is driven by a battery, the ascertainment of the rotation speed limit taking into account a voltage of the battery.

14. A control device for operating a power tool for screwing a screw into a workpiece, the control device designed to:

after an activation of the power tool, drive an electric motor to screw the screw into the workpiece;

ascertain a rotation speed of the electric motor, while the screw is being screwed in, during a predefined initial time of an impact operating mode of the power tool;

ascertain a rotation speed of the electric motor after the initial time; and at least reduce a torque of the electric motor if the ascertained rotation speed of the electric motor exceeds a predefined rotation speed limit.

15. A power tool having a control device, the control device for operating the power tool for screwing a screw into a workpiece, the control device designed to:

after an activation of the power tool, drive an electric motor to screw the screw into the workpiece;

ascertain a rotation speed of the electric motor, while the screw is being screwed in, during a predefined initial time of an impact operating mode of the power tool;

ascertain a rotation speed of the electric motor after the initial time; and at least reduce a torque of the electric motor if the ascertained rotation speed of the electric motor exceeds a predefined rotation speed limit.

* * * * *